US005353650A

United States Patent [19]

Barshay et al.

[11] Patent Number: 5,353,650

[45] Date of Patent: Oct. 11, 1994

[54] METHOD AND APPARATUS FOR CORROSION MONITORING DURING STEAM GENERATOR CLEANING

[75] Inventors: Stephen S. Barshay, W. Hartford; Gordon L. Key; James L. Key, both of Lebanon, all of Conn.; Laura Kwapien, Sunderland, Mass.; Stanley L. Klein, Cromwell, Conn.

[73] Assignee: Combustion Engineering, Inc., Windsor, Conn.

[21] Appl. No.: 999,407

[22] Filed: Dec. 31, 1992

[51] Int. Cl.[5] ..... G01N 1/20

[52] U.S. Cl. ..... 73/863.02; 73/863.23; 376/305

[58] Field of Search ..... 376/305, 249, 245, 246, 376/247, 215, 217; 73/863.02, 863.23; 422/53

[56] References Cited

U.S. PATENT DOCUMENTS

| | | | |
|---|---|---|---|
| 4,570,489 | 2/1986 | Baumaire et al. | 73/658 |
| 4,907,883 | 3/1990 | Allmon et al. | 356/317 |
| 4,978,506 | 12/1990 | Calderwood | 422/73 |
| 5,080,863 | 1/1992 | Gray | 422/14 |
| 5,164,152 | 11/1992 | Kim et al. | 376/305 |
| 5,178,822 | 1/1993 | Buford, III et al. | 376/305 |
| 5,203,984 | 4/1993 | Sakai et al. | 204/435 |

*Primary Examiner*—Donald P. Walsh
*Assistant Examiner*—Meena Chelliah
*Attorney, Agent, or Firm*—Ronald P. Kananen; John H. Mulholland

[57] ABSTRACT

A self-sampling corrosion monitor is structurally adapted to be connected to the blowdown system or other piping systems external to a steam generator. The monitor includes a pump for providing positive solvent flow through the monitor, and a regenerative heat exchanger using recovered heat at the outlet. Magnetite is also added to a sludge cup within the corrosion monitor vessel to simulate real time measurement of short-lived corrosion conditions in the steam generator. In addition, the available corrosion monitoring equipment is modified to provide automatic microprocessor-controlled range selection. Still further, data acquisition, storage, and display techniques are modified.

21 Claims, 4 Drawing Sheets

METHOD AND APPARATUS FOR CORROSION MONITORING DURING STEAM GENERATOR CLEANING

BACKGROUND OF THE INVENTION

This invention relates to a method and apparatus for corrosion monitoring during equipment cleaning. More particularly, this invention relates to a method and apparatus for monitoring corrosion during cleaning of a steam generator, particularly in a nuclear power plant. Still more particularly, this invention relates to a self-sampling monitor for use during steam generator cleaning to measure corrosion due to cleaning solvents in the equipment being cleaned. Still further, this invention relates to an improved automated linear polarization corrosion monitor for use with the self-sampling monitor mentioned above.

A number of processes are known in which corrosion of the equipment caused by process parameters is of concern for reasons including cost of capital equipment, redundancy design, maintenance, safety, and process efficiency. Thus, a number of techniques have been developed over a long period of time for monitoring corrosion in process equipment. One typical method involves the use of a test monitoring coupon which is strategically placed at a location within the process which is considered to be representative of the corrosion occurring in the system being observed. Measurement of the corrosion of the test monitoring coupon thus provides an indication of the status of the corrosion.

In some processes which are not significantly corrosive during normal operation, the most corrosive event for the equipment can occur during cleaning with solvents during equipment shutdown. For example, for steam generators used in producing power, such as in nuclear power plants, a shell and tube type heat exchanger is periodically shut down to remove deposits which occur due to a number of factors, such as the purity of the water, the corrosion of equipment in the entire system which might produce, for example, iron oxide deposits, and the like. During shut down, the steam generator is chemically cleaned by using one or more solvents. One type of steam generator cleaning uses an external heating and solvent recirculation system to maintain solvent temperature during cleaning. The preferred placement of corrosion monitoring coupons and electrodes during chemical cleaning is within the steam generator.

It is often an aim in this art to use, when beneficial, the primary system heat during steam generator chemical cleaning instead of an external heating and solvent recirculation system to maintain solvent temperature. Such a technique would concentrate heating at the tubes and tube crevices, which are difficult to clean, could save time for cleaning by reducing the cool down time necessary to initiate cleaning, and could reduce equipment costs. Thus, such a technique is attractive for use in steam generator cleaning. However, such a technique presents novel challenges for corrosion monitoring. Since the steam generators are not drained or cooled to below approximately 100° C. before cleaning, it is not possible to open the steam generators and install corrosion surveillance equipment before the cleaning. It is not even feasible to make connections directly to the steam generator handholes or other penetrations into the equipment. Instead, connections must be made to permanent isolatable piping systems connected to the steam generator, such as the blowdown piping system for the generator. Connecting a corrosion monitoring vessel to the steam generator in this way causes novel problems. For example, in the time it takes for the chemical cleaning solvent to traverse the blowdown piping and arrive at a corrosion monitoring vessel e.g. about 15 sec., the short-lived corrosive species 15 sec., in the solvent will have decomposed, and the solvent will have cooled to below steam generator temperatures. Conditions in the corrosion monitoring vessel will therefore not be representative of steam generator conditions, and any corrosion measurements made in this vessel will therefore be unreliable.

Accordingly, it is a continuing problem in this art to provide monitoring equipment that provides an indication of corrosion during chemical cleaning and that operates in conjunction with the steam generator cleaning at an earlier time in the cool down cycle.

It is an additional continuing problem in this art to simulate corrosive conditions accurately during steam generator cleaning.

It is still a continuing problem to provide automated corrosion monitoring equipment for use during steam generator chemical cleaning.

SUMMARY OF THE INVENTION

Directed to overcoming the above-identified problems, it is an overall object of this invention to provide a self-sampling corrosion monitor for use during chemical cleaning of a steam generator to measure corrosion.

It is an additional object of this invention to provide a self-sampling corrosion monitor, which can be connected to the blowdown lines or other permanent isolatable piping external to the steam generator, as an external device.

It is a further general object of this invention to provide a corrosion monitoring vessel that is placed at a location remote from the steam generator but that provides an accurate indication of the corrosive effect of cleaning solvents during chemical cleaning of the steam generator.

It is yet another general object of this invention to provide an automated linear polarization corrosion monitor for use with the self-sampling corrosion monitor mentioned above.

In one aspect, the invention relates to a self-sampling corrosion monitor which is structurally adapted to be connected to the blowdown system or other piping systems external to the steam generator. The monitor includes an input for receiving solvent from the steam generator during cleaning. A filter is provided for filtering the solvent and providing the solvent to a pump for providing positive solvent flow through the monitor. The pumped solvent is provided to a regenerative heat exchanger where the solvent is preheated using heat recovered from the outlet of the monitor. Controlled reheating of the chemical cleaning solvent up to the nominal steam generator temperature during cleaning is provided by a controlled heater. The thus-heated solvent is provided to a corrosion monitor vessel in which test coupons are provided for connection to an electrochemical corrosion monitoring system, such as is available commercially. Magnetite is also added to a sludge cup within the corrosion monitor vessel to simulate real time measurement of short-lived corrosion conditions in the steam generator, thus to improve the accuracy of the system.

In a second aspect, the invention relates to improvements in linear polarization corrosion monitoring equipment which is commercially available, thus to provide a nulling and measurement cycle which accommodates multiplexing to several sets of corrosion monitoring electrodes. In addition, the available equipment is modified to provide automatic microprocessor-controlled range selection. Still further, data acquisition, storage, and display techniques are modified. In a specific embodiment, a multiplexer is used to interface four sets of corrosion electrodes that thus provide four data channels, one of which can be connected to a known, electronic corrosion-rate source to confirm equipment accuracy. The improved equipment thus reports, if desired, the corrosion data in real time, and the integrated total corrosion over the full period of time of a chemical cleaning.

A method of such operation is also disclosed.

DETAILED DESCRIPTION OF THE PREFERRED EMBODIMENTS

Figure 1:
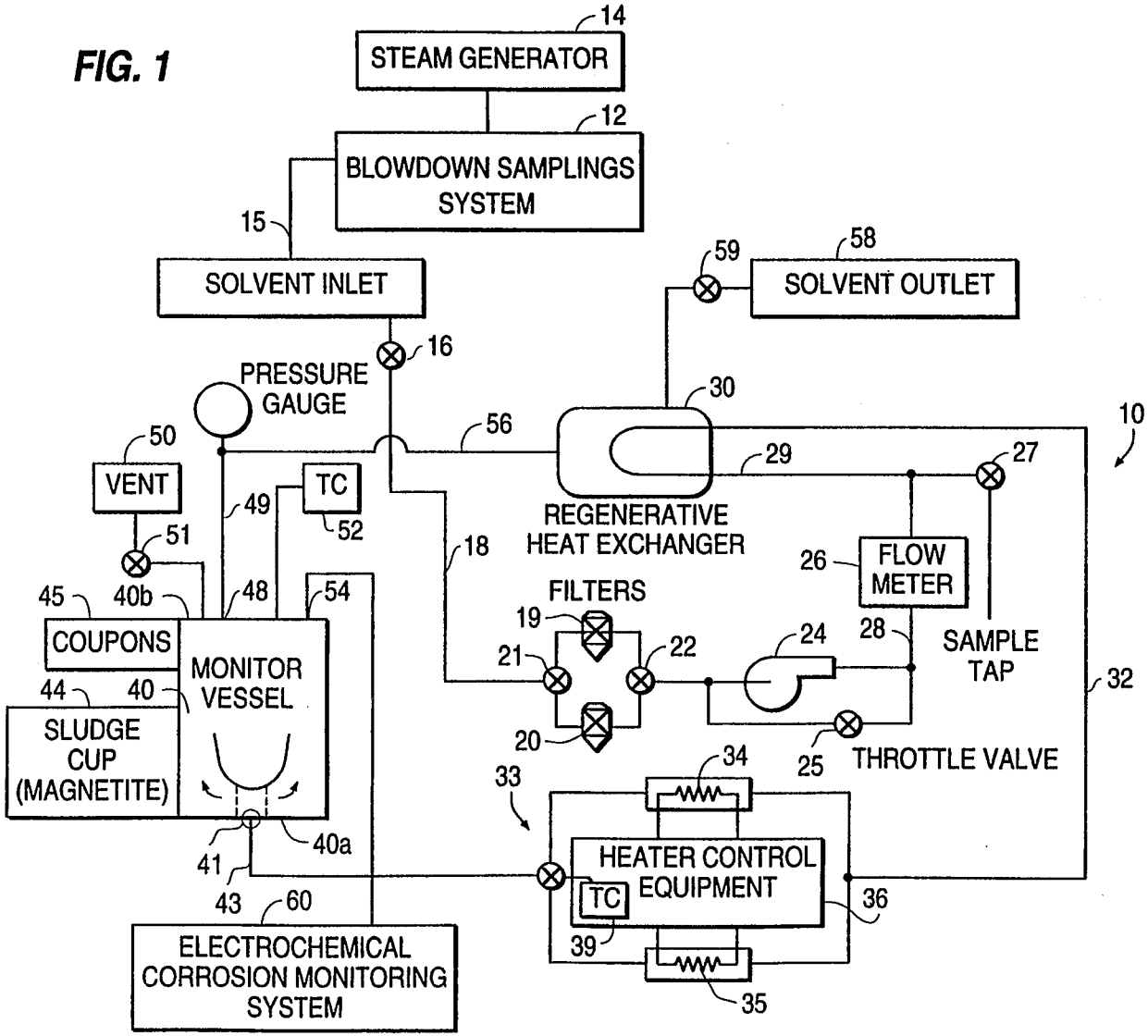
FIG. 1 is a schematic drawing of the self-sampling monitor according to the invention for connection to a steam generator during cleaning.

In FIG. 1, a schematic of the self-sampling monitor according to the invention is shown generally at the reference numeral 10. The monitor is connected to the blowdown and sampling system 12 of a steam generator 14 to provide a source of chemical cleaning solvent at a solvent inlet 16 through a conduit 15. The conduit 15 is tailored to fit the particular installation, and may include, for example, an adaptor having high pressure seal fittings and cam hose fittings to adapt the sample point in the blowdown and sampling system 12 to a chemical-resistant hose of suitable length and diameter. Thus, the monitor 10 according to the invention can be placed and used at a location somewhat remote from the steam generator 14.

The solvent provided at the solvent inlet 16 passes through a conduit 18 to a pair of filters 19, 20 with associated valves 21, 22. The filters may be duplex 10-mesh filters to protect the inlet of a solvent-resistant positive-displacement pump 24 connected to the outlet of the filter/valve network 19, 20, 21, 22. The pump 24 is typically rated at about 7 liters/minute flow rate at 5 Bar and 100° C. A throttle valve 25 bypasses the pump flow, when necessary, to adjust the pump discharge flow to a nominal flow rate, such as about 1 liter per minute, as measured by a flow meter 26. Samples of the solvent for chemical analysis may be taken from a sample tap 27 at the outlet side of the flow meter 26.

The solvent discharge from the outlet of the pump 24 is provided through a conduit 28 to the flow meter 26 and through a conduit 29 to a regenerative heat exchanger 30 which preheats the solvent prior to passage in the conduit 32 to a heater assembly 30 having electric heaters 34, 35 powered by heater control equipment 36. Typically, only one heater is used, the other serves as a backup. The temperature of the solvent at the outlet of the pump 24 is typically about 40° C. The heat source for the heat exchanger 30 is the solvent stream from a corrosion monitoring vessel 40. The pre-heated solvent in the conduit 32 is thus at approximately 60° C. when it enters the heater assembly 33. The electrical heaters 34, 35 typically raise the temperature of the solvent to about 125° C. Power to the electric heater 34 or 35 is switched on or off by a suitable solid state, temperature-controlled power supply contained in the heater control equipment 36, such as one rated at about 15 kW, 220 VAC, depending on the temperature measured by a thermocouple 39 at the outlet of the heater assembly 33 connected to the heater control equipment 36.

The heated solvent is then supplied in a conduit 43 to a stainless steel corrosion monitoring vessel 40 having an integral flow distribution inlet nozzle 41 located at the bottom **40*a* of the vessel 40. The inlet nozzle 41 also acts as a support for a stainless steel sludge cup 44 that provides a source of dissolving magnetite provided into the corrosion monitoring vessel 40. The dissolution of the magnetite thus provided presents a realistic correlation of corrosive species to the heated solvent within the vessel 40. These corrosive species, generated during chemical cleaning by the dissolution of magnetite in the steam generator 14, have a half-life of less than 30 seconds, and therefore decay away during transit from the steam generator 14 to the monitor 10. By knowing the weight of magnetite provided, and the weight of magnetite remaining at the end of the cleaning cycle, the magnetite dissolution can be determined as an indicator of what is truly happening within the steam generator 14** under the influence of the cleaning solvent.

The mass of magnetite placed in the sludge cup 44 is estimated conservatively based on the volume of solvent expected to flow through the self-sampling monitor 10 according to the invention, and the total sludge loading expected in the solvent at the end of the cleaning. The mass of magnetite placed in the sludge cup 44 is the product of the solvent flow rate through the monitor 10, such as in liters per hour, times the length of the chemical cleaning, such as in hours, times the sludge loading expected in the solvent at the end of the chemical cleaning, such as in grams of magnetite per liter of solvent.

Weight loss corrosion coupons 45 are also placed in a rack within and supported by the corrosion monitoring vessel 40. In practice, the rack is supported by the sludge cup 44. By way of example, twenty-five coupons are placed in each monitoring vessel 40, although the rack can hold upwards of 38 coupons. Directly above the coupon racks is the vessel head **40*b* having the housing outlet 48 connected to an outlet conduit 49, a vent 50, having a valve 51 in line with the vessel head 40*b*, a thermocouple 52, and the electrochemical corrosion monitoring penetrations 54**. The electrochemical electrodes are mounted on glass-to-metal seals and include two pairs of "Zero Resistance Ammetry" electrodes, as well as seven electrodes for three "Linear Polarization" channels.

Equipment suitable for use in the electrochemical corrosion monitoring system is commercially available, as described in a brochure entitled "Polarization Resistance (PAIR) Monitoring", available from Cortest Instrument Systems (PAIR is a trademark of Cortest Instrument Systems, Inc.); a brochure entitled "Multi-Station Monitoring System IN-6000" available from Cortest Instrument Systems, Inc.; and a brochure from that same source entitled "IN-5000 Multifunction Corrosion Analyzer". The IN-6000 Multi-Station Monitoring System may be used with an IN-6010 Linear Polarization corrosion rate monitor. Probes, seals, chucks, racks, gaskets, and glass-to-metal seals compatible with such equipment are also available.

Solvent exits from the corrosion monitoring vessel 40 through a conduit 56 to the input of the regenerative heat exchanger 30 where a part of the energy of the solvent is surrendered to the incoming solvent stream. Thus, the discharge temperature of the solvent at the regenerative heat exchanger 30 is a nominal 80° C. The discharged solvent is thus fed to a waste stream consistent with acceptable and approved environmental practices at the solvent outlet 58, through an outlet valve 59. As an alternative, in certain circumstances, the solvent could be returned to the steam generator 14.

The preferred embodiment of the invention is intended to operate at a Hydro Test condition of 7 BAR (for verifying leakproof piping under pressure), with an inlet temperature in a range of 30° to 90° C., an inlet pressure in a range of 5 to 6 BAR, a monitor temperature of about 125° C., a discharge temperature of about 80° C., a nominal flow of up to 2 liters per minute, and a conduit specification between the steam generator 14 and the monitor 10 of 12 BAR at about 93° C.

With the preferred embodiment of the monitor, a number of features are of interest. First, a use of pumped solvent flow by the pump 24 compensates for a lack of pressure in the sample lines. This feature for the monitor 10 permits connection of the monitor 10 directly to the blowdown system 12 or other piping systems external to the steam generator 14. This feature also allows the corrosion monitoring vessel 40 to be placed at a distance far from the steam generator 14, thereby reducing radiation exposures during both installation and operation of the monitor 10.

Second, controlled reheating of the chemical cleaning solvent up to the nominal steam generator temperature during the chemical cleaning compensates for a loss of heat in the sample lines. Thus, the accuracy of the corrosion measurements is improved.

Third, use of a regenerative heat exchanger 30 to heat incoming solvent in conduit 29 and to cool the waste solvent in conduit 56 reduces the power requirements of the system. it also eliminates a need for cooling water to cool the outlet stream that might otherwise flash to steam.

Fourth, inclusion of actual or synthetic steam generator sludge in sludge cup 44 in the corrosion monitoring vessel 40 provides a more accurate measure of occurrences within the steam generator 14 for observation at a location remote from the generator 14. Use of synthetic magnetite placed in the corrosion monitoring vessel 40 during steam generator cleaning allows for a slow dissolution of such magnetite and thus compensates for the decomposition during transit of a postulated short-lived decomposition species produced within the steam generator by the dissolution of the sludge. Replenishment of the corrosive species is thus considered to improve the accuracy of the corrosion measurements.

Fifth, the use of redundant filters 19, 20 and heaters 34, 35 improves the reliability of the system.

Referring again to FIG. 1, it is seen that the electrodes in the vessel 40 are monitored by an electrochemical corrosion monitoring system 60, having corrosion electrodes and holders for such electrochemical corrosion monitoring, whether Zero Resistance Ammetry electrodes or electrodes for three Linear Polarization channels, such as are available in the prior art, such as from Cortest Instruments Systems. A Cortest (formerly Petrolite) IN-6000 Multi Station Monitoring System, with an IN-6010 Linear Polarization corrosion rate monitor, including analog to digital converter and compatible data acquisition hardware are readily available commercially.

Figure 2:
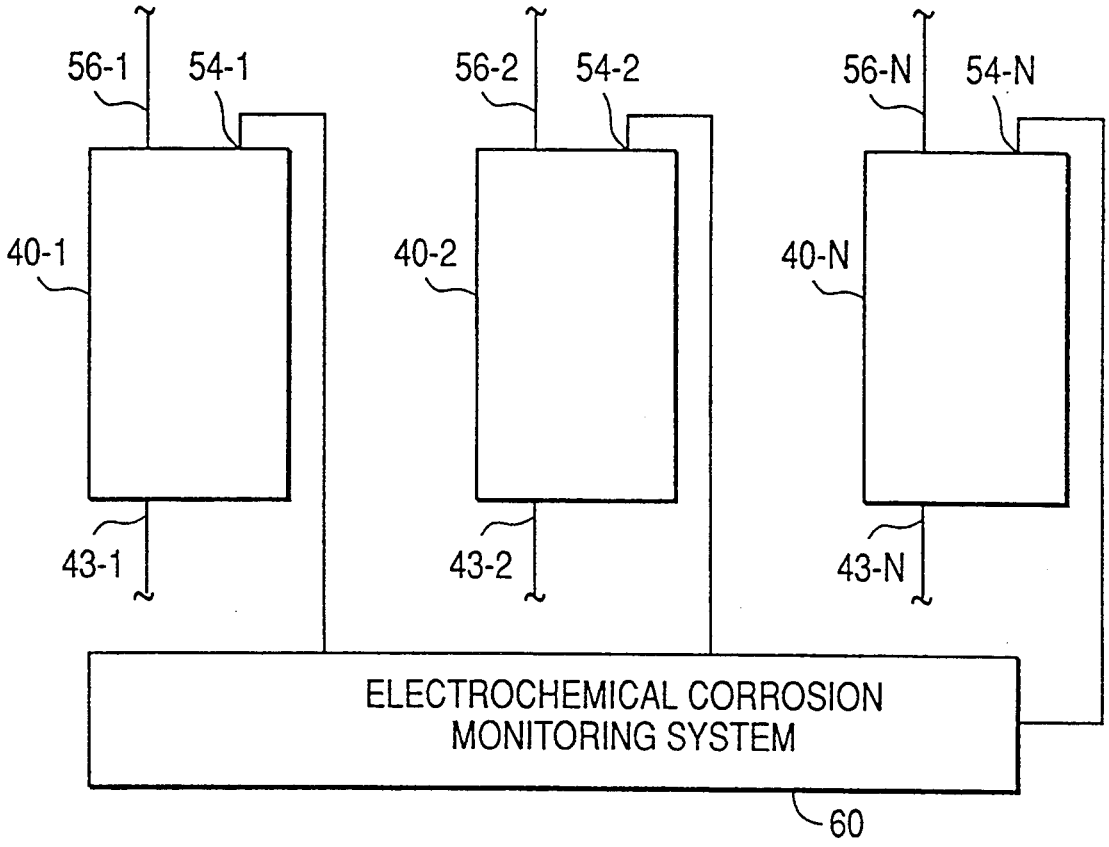
FIG. 2 is a schematic drawing of a plurality of monitoring vessels which may be used in the self-sampling monitor according to FIG. 1.

The equipment shown in the block labeled Electrochemical Corrosion Monitoring System 60 may at its simplest include equipment adequate to monitor one steam generator 14 at a time during chemical cleaning, using the self-sampling monitor 10 shown in FIG. 1. Alternatively, as shown in FIG. 2, a plurality of corrosion monitoring vessels 40-1, 40-2, . . . 40-n may be used, each of which includes provisions for installation of corrosion monitors 10 as shown in FIG. 1.

The electrodes selected for the monitoring vessel 40 are matched with the steam generator component in the steam generator, as determined by the heat transfer tubes, tube sheet, shell, tube sheet weld, nozzle boss weld, support wedges, tube support, separation deck drain, flow skirt and other components of the steam generator. Various kinds of electrodes are commercially available which are compatible with the equipment described above. The corroding monitoring electrodes included in the process monitor also match the shell, tube sheet, and tube support when using linear polarization techniques, and match the flow skirt and tube support when using zero resistance ammetry.

As noted above, the electrochemical corrosion monitoring system 60 may also include a Linear Polarization System, to measure free corrosion rates, and Zero Resistance Ammetry, to measure galvanic corrosion rates. A second aspect of the invention relates to improvements in a Linear Polarization System (LP System). Historically, Linear Polarization (LP) corrosion monitoring technology evolved about the use of a Model M-1010 corrosion monitor manufactured by Petrolite Corporation, now Cortest Measuring Systems. The Model M-1010 monitor multiplexes up to 10 data channels to a single corrosion-rate meter, and provides data output to a strip chart recorder. This aspect of the invention relates to modifications to the M-1010 corrosion monitor to provide an external data signal to a computerized data acquisition, storage and display system, thus eliminating the strip-chart recorder. The data acquisition consists of customized software run on a personal computer.

Figure 3:
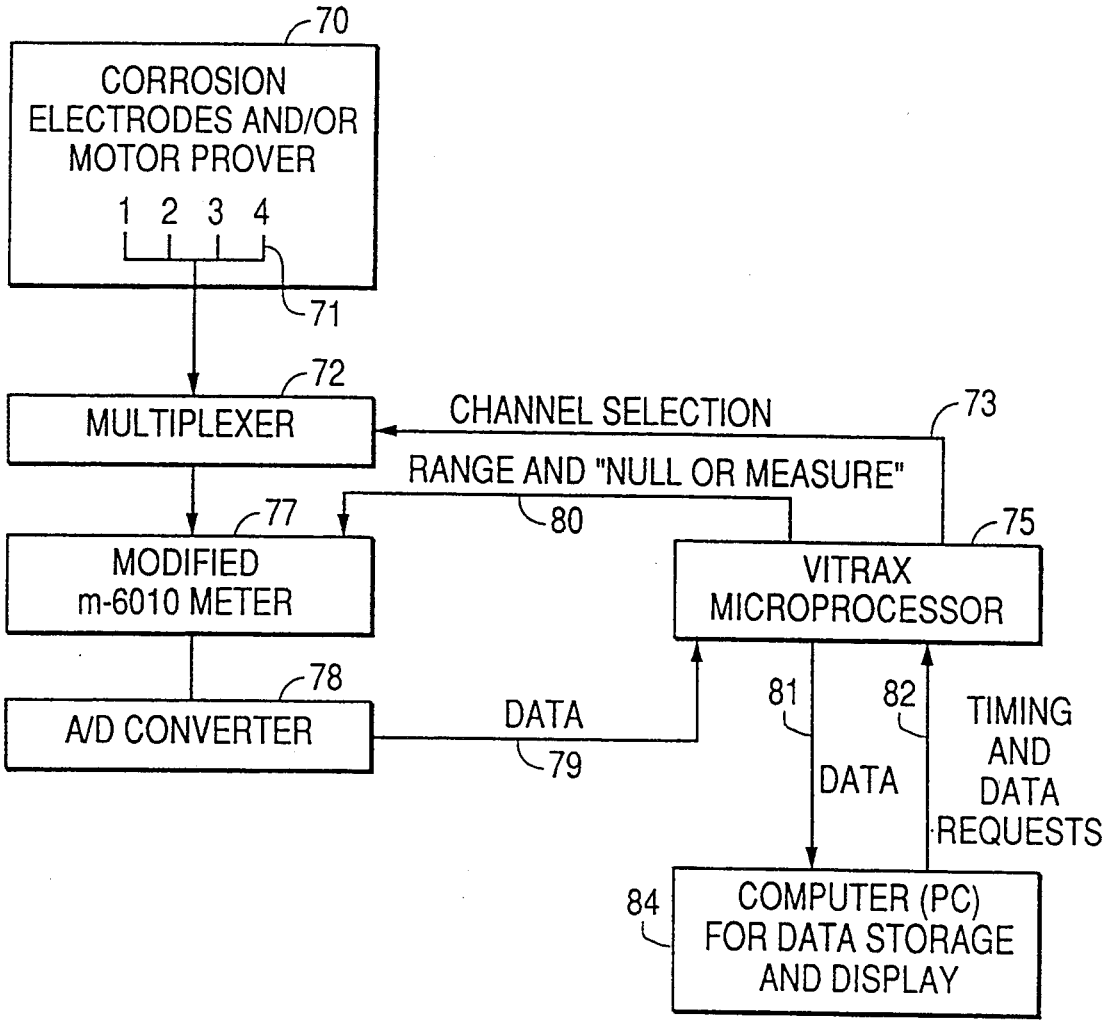
FIG. 3 is a block diagram of an improved linear polarization monitoring system according to a second aspect of the invention.
Figure 4:
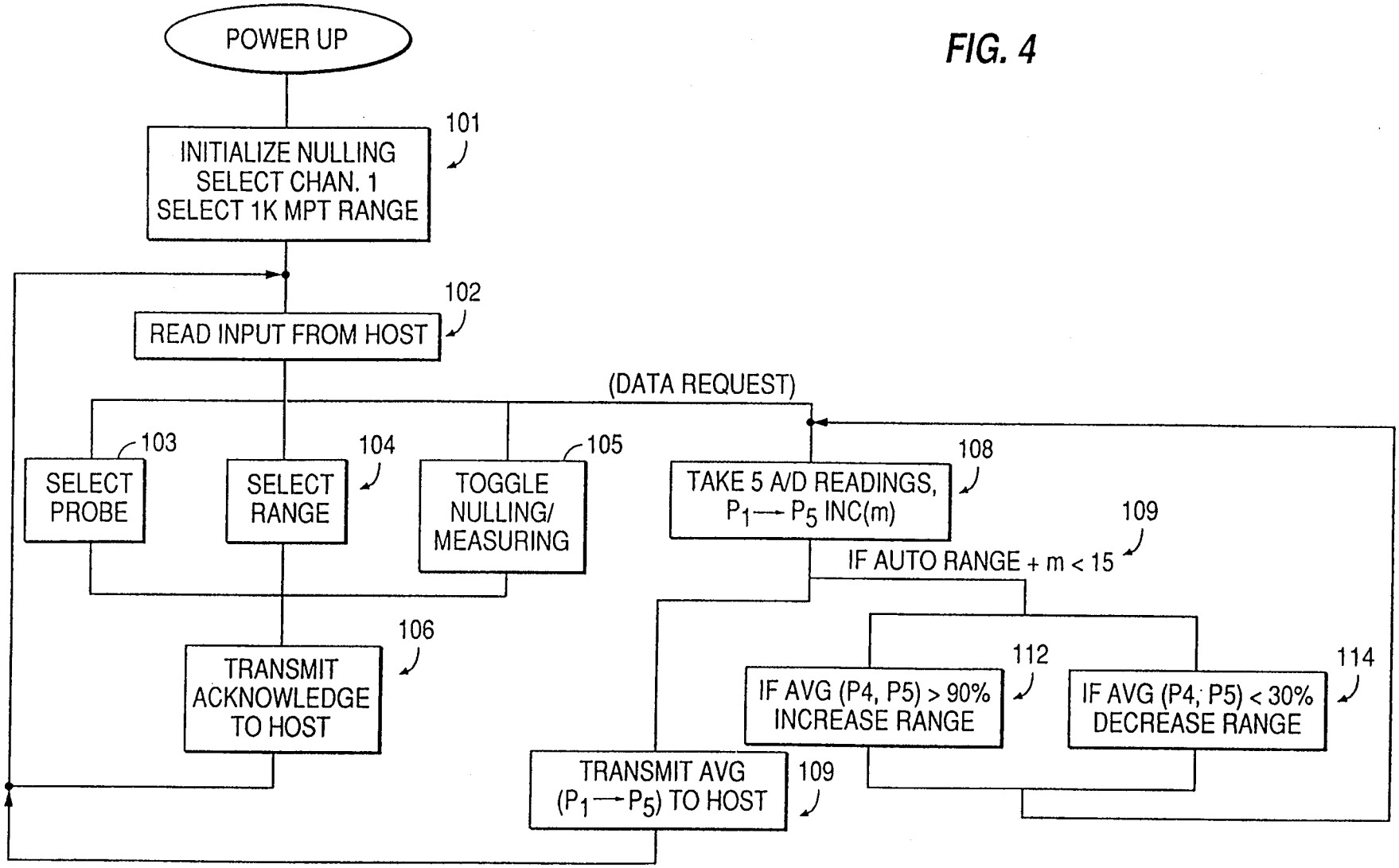
FIG. 4 is a routine for the microprocessor of FIG. 3 to provide channel selection, range and null control, and data acquisition control.

Thus, FIG. 3 shows a block diagram of a Linear Polarization (LP) corrosion monitoring system useful as the system 60 used in connection with the self-sampling monitor 10 of FIG. 1. A plurality of corrosion electrodes 71, housed in the monitor vessel 40, and/or a meter prover electronic package, are shown generally at a block 70, providing a corresponding number of outputs to a multiplexer 72 controlled by a channel selection signal 73 on a conduit 74 from a microprocessor 75, such as a Vitrax microprocessor. A routine for the microprocessor 75 is shown in FIG. 4.

The output from the multiplexer 72 is provided to a modified M-6010 meter 77 and to an A/D converter 78 to provide digitized data on the lead 79 to the microprocessor 75. A range and null or measure control signal is provided from the microprocessor 75 on the lead 80 to the meter 77. Timing and data requests are provided from a PC computer 84 for data storage and display, on a conduit 82, while data from the microprocessor 75 is provided to the computer 84 on a conduit 81.

In practice, one or more of the available data channels 71 are connected to a corrosion simulation that provides a known corrosion-rate reading. This provides a quality check on the accuracy and stability of the corrosion-rate meter. Such a quality check is effective because a single corrosion-rate meter is multiplexed by the multiplexer 72 to all of the data channels 71 and to the known corrosion source.

As mentioned, a Cortest IN-6010 monitoring system is a part of the IN-6000 Multi-Station Monitoring System, which also includes modules for hydrogen rate monitoring (IN-6020) and Zero Resistance Ammetry (IN-6030), as well as Linear Polarization (LP). As provided, each IN-6010 module has one channel for one set of electrodes per module, without multiplexing (which is a disadvantage,) analog output of measured corrosion rate (which thus requires an A/D converter to interface with a computer,) manual selection of ranges, and alarms.

Such equipment is modified according to this second aspect of the invention in the following respects. First, the nulling/measurement cycle has been modified to accommodate multiplexing to several sets of electrodes 71. The nulling/measurement cycle is controlled by the data acquisition computer 84 by way of the intermediary microprocessor 75. Second, the manual selection of range is removed and replaced with connections to allow the microprocessor to control the ranging, as noted by the signal on lead 80 from the microprocessor 75 in FIG. 3. Third, the alarm circuitry is removed.

In practice, one multiplexer 72 interfaces a plurality of sets 71 of corrosion electrodes, such as four in number (i.e. four data channels). In addition, the computer 84 controls the nulling/measurement cycle of the IN-6010 meter, calculates the average corrosion rate for each cycle of each channel and stores these data and the elapsed time on hard and/or floppy discs, and calculates the cumulative total corrosion for each channel and similarly stores these data.

Thus, the system as described provides automatic ranging of a linear polarization corrosion monitoring device, a feature which is particularly useful when monitoring chemical cleaning since the corrosion rates vary over a wide range. Moreover, the combination of the LP corrosion meter, multiplexer, and A/D converter in a single unit is advantageous.

A suitable routine for the microprocessor 75 is shown in FIG. 4. The units is powered at step 101, where nulling is initialized, a channel (such as channel 1) selected and a predetermined meter range (such as 1K mpy) is selected. The input from the host computer is read at a step 102, which prompts steps 103, 104, and 105 where a probe is selected, a range is selected, and toggle nulling/measuring is selected respectively, and an acknowledgement is transmitted in a step 106 to the host computer.

The A/D input is read at a step 108, for a plurality of readings, such as five readings P1 to P5. The average is transmitted in a step 109 to the host computer for data acquisition and storage. The average is also checked at a step 110 to see if autorange and error are within appropriate tolerances, so that the range can be increased in a step 112 or decreased in a step 114 as desired.

These and other features of the invention will be apparent to one skilled in this art from a review of this written description of the invention.

What is claimed is:

1. A self-sampling monitor for corrosion monitoring during chemical cleaning of a steam generator, comprising:

receiving means structurally adapted for connection directly to a steam generator for receiving cleaning solvent therefrom during chemical cleaning;

means for pumping said solvent from said receiving means through treatment and monitoring portions of said monitor which are remote from said steam generator;

said treatment portion of the monitor including a heat exchanger means for preheating said solvent to a first temperature, heater means for heating said solvent to a second higher temperature, and means associated with said heater means for controlling said second temperature of said solvent; and said monitoring portion of the monitor comprising corrosion monitoring means, including a corrosion monitoring vessel for receiving said solvent from said treatment portion of the monitor and providing a parameter indicative of said corrosion, and a corrosion monitoring system for converting said parameter into a corrosion measurement.

2. The monitor as set forth in claim 1 wherein said monitoring vessel houses a plurality of electrodes for providing corrosion signals representative of the outputs of said electrodes.

3. The monitor as set forth in claim 1 wherein said monitoring vessel includes means for receiving a corrosion product therein, so that dissolution of said corrosion product will cause corrosion that is indicative of corrosion in said steam generator.

4. The monitoring as set forth in claim 1 wherein said corrosion monitoring system is a linear polarization corrosion rate meter having automatic ranging controlled by a microprocessor depending on the magnitude of a sensed signal, thus to provide real time signals over a wide range of corrosion rates.

5. The monitor as set forth in claim 1 wherein said corrosion monitoring system is a linear polarization corrosion-rate meter in combination with a multiplexer controlled by a microprocessor to select one of a plurality of channels of outputs from electrodes in said corrosion vessel.

6. The monitor as set forth in claim 5 further including an A/D converter.

7. The monitor as set forth in claim 1 further including filter means for filtering incoming solvent prior to pumping.

8. The monitor as set forth in claim 1 further including means for controlling solvent flow rate though said monitor.

9. The monitor as set forth in claim 1 further including a plurality of corrosion monitoring electrodes in said corrosion monitoring vessel, each providing an output signal.

10. A linear polarization corrosion monitoring system, comprising:

a plurality of electrodes for providing signals representative of corrosion of an item of interest;

means for multiplexing said signals to enable the selection of one of the said signals; and means for selecting one of said signals and for selecting a range on a meter for displaying a corrosion rate represented by said selected signal, said selecting means including a microprocessor for sampling a plurality of said selected signals and commanding an increase or a decrease in said range on said meter when required to display said selected signals.

11. The system as set forth in claim 10 further including means for converting said selected signals from analog to digital to provide data to said microprocessor.

12. The system as set forth in claim 10 wherein said plurality of electrodes are located in a corrosion vessel, said corrosion vessel receiving cleaning solvent from a steam generator during cleaning.

13. The system as set forth in claim 12 wherein said corrosion vessel is located at a position remote from said steam generator.

14. The system as set forth in claim 13, wherein said corrosion vessel is in combination with a pump means for pumping said cleaning solvent and means for heating and controlling the temperature of said solvent to simulate an environment within said steam generator during cleaning.

15. A method for measuring corrosion caused by cleaning solvent during chemical cleaning of a steam generator, comprising the steps of:

providing cleaning solvent from said steam generator to a corrosion monitoring vessel located remote from said steam generator; and measuring corrosion of a supply of magnetite in communication with the cleaning solvent within said corrosion monitoring vessel to provide an indication of the corrosion of said steam generator during said chemical cleaning, said measuring step including measuring said corrosion by using an electrochemical corrosion monitoring system.

16. The method as set forth in claim 15, further including the step of selecting a signal from one of a plurality of electrodes from said electrochemical corrosion monitoring system in said corrosion monitoring vessel.

17. The method as set forth in claim 16, further including a range for display and data recording based on said selected signal.

18. The system as set forth in claim 10, further including means to record data representative of said selected signals.

19. The monitor as set forth in claim 1, wherein said heat exchanger means transfers heat from solvent exiting said monitoring portion to solvent pumped from said receiving means in order to preheat the solvent to said first temperature.

20. The monitor as set forth in claim 1, wherein said heater means heats the solvent to a temperature approximating the temperature of the steam generator during cleaning.

21. The monitor as set forth in claim 3, wherein said corrosion product is magnetite.

* * * * *